US005669938A

United States Patent [19]

Schwab

[11] Patent Number: 5,669,938

[45] Date of Patent: Sep. 23, 1997

[54] EMULSION DIESEL FUEL COMPOSITION WITH REDUCED EMISSIONS

[75] Inventor: Scott Daniel Schwab, Richmond, Va.

[73] Assignee: Ethyl Corporation, Va.

[21] Appl. No.: 576,323

[22] Filed: Dec. 21, 1995

[51] Int. Cl.[6] ..... C10L 1/22

[52] U.S. Cl. ..... 44/301; 44/324; 44/359

[58] Field of Search ..... 44/301, 324, 359

[56] References Cited

U.S. PATENT DOCUMENTS

| | | | |
|---|---|---|---|
| 2,280,217 | 4/1942 | Cloud | 44/324 |
| 2,858,200 | 10/1958 | Broughten | 44/324 |
| 4,207,078 | 6/1980 | Sweeney et al. | 44/359 |
| 4,406,665 | 9/1983 | Filbey | 44/324 |
| 4,585,461 | 4/1986 | Gorman | 44/324 |
| 4,892,562 | 1/1990 | Bowers et al. | 44/324 |
| 5,501,714 | 3/1996 | Valentine et al. | 44/358 |

FOREIGN PATENT DOCUMENTS

| | | |
|---|---|---|
| 0475620 | 8/1991 | European Pat. Off. . |

*Primary Examiner*—Jacqueline V. Howard
*Attorney, Agent, or Firm*—Dennis H. Rainear; Thomas Hamilton

[57] ABSTRACT

A fuel composition which comprises a water-in-oil emulsion comprising a major proportion of a hydrocarbonaceous middle distillate fuel and about 1 to about 40 volume percent water, and an emission reducing amount of at least one fuel-soluble organic nitrate ignition improver such as 2-ethylhexyl nitrate provides important benefits for reduction of exhaust emissions from diesel engines.

20 Claims, No Drawings

EMULSION DIESEL FUEL COMPOSITION WITH REDUCED EMISSIONS

BACKGROUND OF THE INVENTION

The present invention relates to water-in-oil emulsions in middle distillate fuel, particularly diesel fuel, which are useful in reducing diesel exhaust emissions.

The importance and desirability of reducing the emissions from internal combustion engines which operate on hydrocarbonaceous fuels into the atmosphere are well recognized. Among the emissions sought to be reduced are nitrogen oxides ($NO_x$), carbon monoxide (CO), unburned hydrocarbons, and particulate matter (PM).

It is known in the art that dispersions of water and/or one or two carbon alkanols in diesel fuel serves to reduce undesirable diesel emissions such as CO, particulates and $NO_x$, but with an undesired increase in unburned hydrocarbons (HC). It is also well-known that debits associated with water and alkanols in diesel fuels include a substantial reduction in cetane number and a marked ignition delay often requiring engine and/or operating parameter modification such as advanced ignition timing or the installation of glow plugs. Such problems are addressed, for example, in European patent application EP 475 620 A2 by incorporating a water soluble oxidizing and/or nitrogenous reagent into the aqueous portion of the fuel emulsion composition. An emulsion fuel with enhanced emission performance represents an important advancement to benefit the environment.

SUMMARY OF THE INVENTION

A fuel composition which comprises a water-in-oil emulsion comprising a major proportion of a hydrocarbonaceous middle distillate fuel and about 1 to about 40 volume percent water, and an emission reducing amount of at least one fuel-soluble organic nitrate ignition improver provides important benefits for reduction of exhaust emissions from diesel engines.

DESCRIPTION OF THE PREFERRED EMBODIMENT

In the practice of the present invention, applicant has discovered that during operation of internal combustion engines or other combustion apparatus operated on middle distillate fuel having incorporated therein a water-in-oil emulsion, it is possible to obtain important benefits in the levels of emissions that result from use of the emulsion in the fuel. This is accomplished by having dissolved in the oil portion of the water-in-oil emulsion fuel a combustion improving amount of at least one fuel-soluble organic nitrate ignition improver. It has been found possible through use of such fuel compositions containing the organic nitrate ignition improver to further reduce the levels of CO and particulates while maintaining the reduced level of $NO_x$ and reducing the amount of increase in unburned hydrocarbons obtained by the prior art water-in-oil emulsion diesel fuels. This is a unique discovery since the available experimental evidence and mechanistic theories of combustion suggest that if $NO_x$ is reduced, the amount of particulates will be increased, and vice versa.

This invention provides in one of its embodiments a water-in-oil emulsion fuel composition which comprises a major proportion of a hydrocarbonaceous middle distillate fuel, water and a minor emission reducing amount of at least one fuel-soluble organic nitrate ignition improver dissolved therein. By the term "hydrocarbonaceous" as used in the ensuing description and appended claims is meant the middle distillate fuel is composed principally or entirely of fuels derived from petroleum by any of the usual processing operations. The finished fuels may contain, in addition, minor amounts of non-hydrocarbonaceous fuels or blending components such as alcohols, dialkyl ethers, or like materials, and/or minor amounts of suitably desulfurized auxiliary liquid fuels of appropriate boiling ranges (i.e., between about 160° and about 370° C.) derived from tar sands, shale oil or coal.

In another of its embodiments this invention provides improvement in combustion processes wherein a hydrocarbonaceous middle distillate fuel is subjected to combustion in the presence of air within a combustion chamber of a compression ignition diesel engine. Such improvement serves to reduce the amount of particulates in the exhaust gases of the diesel engine, and comprises providing to the combustion chamber as a fuel used in such process a water-in-oil emulsion hydrocarbonaceous middle distillate fuel which has dissolved therein a minor emission reducing amount of at least one fuel-soluble organic nitrate ignition improver.

Additional embodiments of this invention involve improvements in the operation of motor vehicles and aircraft which operate on middle distillate fuels. These improvements involve fueling the vehicle or aircraft with a water-in-oil emulsion hydrocarbonaceous middle distillate fuel containing a minor emission-improving amount of at least one fuel-soluble organic nitrate ignition improver dissolved therein.

The hydrocarbonaceous fuels utilized in the practice of this invention are comprised in general of mixtures of hydrocarbons which fall within the distillation range of about 160° to about 370° C. Such fuels are frequently referred to as "middle distillate fuels" since they comprise the fractions which distill after gasoline. Such fuels include diesel fuels, burner fuels, kerosenes, gas oils, jet fuels, and gas turbine engine fuels.

Preferred middle distillate fuels are those characterized by having the following distillation profile:

| | °F. | °C. |
|---|---|---|
| IBP | 250–500 | 121–260 |
| 10% | 310–550 | 154–288 |
| 50% | 350–600 | 177–316 |
| 90% | 400–700 | 204–371 |
| EP | 450–750 | 232–399 |

Diesel fuels having a clear cetane number (i.e., a cetane number of the fuel when devoid of any cetane improver such as a fuel-soluble organic nitrate ignition improver) in the range of 30 to 60 are preferred.

The organic nitrate ignition improvers comprise nitrate esters of substituted or unsubstituted aliphatic or cycloaliphatic alcohols which may be monohydric or polyhydric. Preferred organic nitrates are substituted or unsubstituted alkyl or cycloalkyl nitrates having up to about 10 carbon atoms, preferably from 2 to 10 carbon atoms. The alkyl group may be either linear or branched (or a mixture of linear and branched alkyl groups). Specific examples of nitrate compounds suitable for use in the present invention include, but are not limited to, the following: methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, n-heptyl nitrate, sec-heptyl nitrate, n-octyl nitrate, 2-ethylhexyl nitrate, sec-octyl nitrate, n-nonyl nitrate, n-decyl nitrate, cyclopentyl nitrate, cyclohexyl nitrate, methylcyclohexyl nitrate, isopropylcyclohexyl nitrate, and the like. Also suitable are the nitrate esters of alkoxy substituted aliphatic alcohols such as 2-ethoxyethyl nitrate, 2-(2-ethoxy-ethoxy) ethyl nitrate, 1-methoxypropyl-2-nitrate, 4-ethoxybutyl nitrate, etc., as well as diol nitrates such as 1,6-hexamethylene dinitrate, and the like. While not particularly preferred, the nitrate esters of higher alcohol may also be useful. Such higher alcohols tend to contain more than 10 carbon atoms. Preferred are the alkyl nitrates having from 5 to 10 carbon atoms, most especially mixtures of primary amyl nitrates, mixtures of primary hexyl nitrates, and octyl nitrates such as 2-ethylhexyl nitrate.

Nitrate esters are usually prepared by the mixed acid nitration of the appropriate alcohol or diol. Mixtures of nitric and sulfuric acids are generally used for this purpose. Another way of making nitrate esters involves reacting an alkyl or cycloalkyl halide with silver nitrate.

The concentration of organic nitrate ester component in the fuel can be varied within relatively wide limits with the proviso that the amount employed is at least sufficient to further reduce the levels of CO and particulates while maintaining the reduced level of $NO_x$ and reducing the amount of increase in unburned hydrocarbons when compared to the same water-in-oil emulsion diesel fuel in the absence of the organic nitrate ester component. Generally speaking, the amount of organic nitrate ester employed will fall in the range of about 500 to about 50,000 parts by weight of organic nitrate ester per million parts by weight of the fuel. Preferred concentrations usually fall within the range of 1,000 to 10,000 parts per million parts of fuel.

A wide variety of emulsion fuel compositions are known in the art, with substantial attention directed to particular surfactants useful to obtain desired properties including stability of the emulsion fuel at conditions to which the emulsion fuel will be exposed. See, for example, the above referenced EP 475 620 A2. The emulsion is prepared in known ways by combining water, fuel, desired surfactants and additives in desired proportions and in desired order of addition and shaking, blending or using high-speed mixing to obtain the desired emulsion. The water-in-oil emulsion fuel composition of the invention comprises, for example, a hydrocarbonaceous middle distillate fuel, preferably diesel fuel; about 1 to about 40 weight percent, more preferably about 2 to about 20 weight percent; and an emission reducing amount of at least one fuel-soluble organic nitrate ignition improver, preferably about 500 to about 50,000 parts by weight of organic nitrate ignition improver per million parts by weight of the fuel, more preferably 1,000 to 10,000 parts of organic nitrate ignition improver per million parts of fuel.

In addition, the water-in-oil emulsion fuel may contain known surfactants to add stability to the emulsion.

It may be preferred to employ the organic nitrate ester component of the invention in the fuel in combination with at least one hydrocarbyl peroxide, in an amount sufficient to increase the thermal stability of the fuel over the same fuel containing the nitrate ester in the absence of the hydrocarbyl peroxide. The hydrocarbyl peroxides used in the practice of this invention may be represented by the general formula $R_1$—O—O—$R_2$ wherein each of $R_1$ and $R_2$ are the same or different and are selected from hydrogen, primary, secondary, or tertiary alkyl, cycloalkyl, alkylaryl, and aralkyl groups or hetero-substituted hydrocarbon radicals, with the proviso that at least one of $R_1$ and $R_2$ is a hydrocarbyl radical. Particularly preferred are the di-hydrocarbyl peroxides such as di-tert-butyl peroxide, dipropionyl peroxide, di-acetyl peroxide, and tert-butyl tert-cumyl peroxide, most preferably di-tert-butyl peroxide. Another useful type of peroxide is the hydrocarbyl hydroperoxides such as tert-amyl hydroperoxide, tert-butyl hydroperoxide, cyclohexyl hydroperoxide, and the hydroperoxide of cumene. Blends of fuels containing varying amounts of organic nitrate ester alone and in combination with various amounts of hydrocarbyl peroxide can be tested for thermal stability using the F-21-61 149° C. (300° F.) change and insoluble gums are determined on a 50 mL sample which is heated to 149° C. for a selected time (for example 90 minutes), allowed to cool in the dark, tested for color (ASTM D-1500), and then filtered (using a 4.25 cm Whatman #1 filter paper) and the filtrate discarded. The filter is washed clean of fuel with isooctane and measured for deposits by comparison with a set of reference papers to obtain the "PAD rating" according to the F-21-61 stability test.

The preferred hydrocarbyl peroxides used in accordance with the present invention should be lower molecular weight peroxides, i.e., those which contain no more than 15 carbon atoms per molecule and preferably no more than 12 carbon atoms per molecule. Di-tertiary-butyl peroxide and cumene hydroperoxide, have 8 and 9 carbon atoms per molecule, respectively and are the particularly preferred hydrocarbon peroxides for use in the combination according to our invention.

The base fuel will normally contain an amount in the range of 500 to about 50,000 and preferably, from about 1,000 to about 10,000—parts of the hydrocarbyl peroxide per million parts by weight of the base fuel (ppm). Such quantities are normally sufficient, when in combination with a substantially similar amount of organic nitrate ignition improver, to improve the thermal stability of the fuel as compared to the thermal stability of the same fuel containing organic nitrate in the absence of a synergistic amount of hydrocarbyl peroxide. Since the organic nitrates and the hydrocarbyl peroxides both tend to increase the cetane number of the fuel, the use of substantially equal amounts of organic nitrate and hydrocarbyl peroxide additives provides fuel with a cetane number similar to the cetane number achieved by the use of organic nitrate alone, while at the same time increasing the thermal stability of the fuel. It is recognized, of course, that substantially more hydrocarbyl peroxide than organic nitrate can also be used. However, only that amount of hydrocarbyl peroxide needed to increase the thermal stability is required by the present invention.

Other additives may be included within the fuel compositions of this invention provided they do not adversely affect the exhaust emission reductions achievable by the practice of this invention. Thus use may be made of such components as organic peroxy esters, corrosion inhibitors, antioxidants, anti-rust agents, detergents and dispersants, lubricity agents, demulsifiers, dyes, inert diluents, and like materials, as well as manganese or other metal containing ignition improvers.

In a preferred fuel, use is made of a cyclopentadienyl manganese tricarbonyl compound of the type described in U.S. Pat. Nos. 2,818,417 and 3,127,351. Thus use can be made of such compounds as cyclopentadienyl manganese tricarbonyl, methylcyclopentadienyl manganese tricarbonyl, ethylcyclopentadienyl manganese tricarbonyl, dimethylcyclopentadienyl manganese tricarbonyl, trimethylcyclopentadienyl manganese tricarbonyl, propylcyclopentadienyl manganese tricarbonyl, isopropylcyclopentadienyl manganese tricarbonyl, butylcyclopentadienyl manganese tricarbonyl, pentylcyclopentadienyl manganese tricarbonyl, hexylcyclopentadienyl manganese tricarbonyl, ethylmethylcyclopentadienyl manganese tricarbonyl, dimethyloctylcyclopentadienyl manganese tricarbonyl, dodecylcyclopentadienyl manganese tricarbonyl, indenyl manganese tricarbonyl, and like compounds in which the cyclopentadienyl moiety contains up to about 18 carbon atoms. A preferred organomanganese compound is cyclopentadienyl manganese tricarbonyl. Particularly preferred for use in the practice of this invention is methylcyclopentadienyl manganese tricarbonyl. Methods for the synthesis of cyclopentadienyl manganese tricarbonyls are well documented in the literature, see U.S. Pat. Nos. 2,868,816; 2,898,354; 2,960,514; and 2,987,529, among others. The hydrocarbonaceous fuel portion of the water-in-oil emulsion fuel may contain at least one fuel-soluble cyclopentadienyl manganese tricarbonyl compound, preferably in an amount equivalent to up to 0.016 gram of manganese per liter of hydrocarbonaceous fuel, more preferably in the range of about 0.0005 to about 0.002 gram of manganese per liter of hydrocarbonaceous fuel.

EXAMPLE

In the following tests, the hot-start portion of the heavy duty transient emissions cycle of the U.S. Environmental Protection Agency Federal Test Procedure (FTP) specified in the Code of Federal Regulations at Title 40, part 86, subpart N, was utilized to measure emissions and to evaluate a ignition improver to determine its effect on emissions. Data collected during this testing is reported in Table 1. Philips 2-D diesel fuel (DF) was used throughout the testing. Hot-start emissions from a 1993 DDC Series 60 diesel engine were measured for DF, a water-in-oil emulsion of DF with 10 volume percent water, a water-in-oil emulsion of DF with 10 volume percent water and 0.5 weight percent 2-ethylhexyl nitrate (2-EHN) based on weight of DF, and a water-in-oil emulsion of DF with 10 volume percent water and 2.0 weight percent 2-ethylhexyl nitrate were tested. The water-in-oil emulsion was prepared in the following manner. An emulsifier mixture which contained 3 parts sorbitan monooleate (supplied by Aldrich Chemical) and 1 part Tween 85 (supplied by ICI Americas) was dissolved at 1 weight percent in DF. Water was added to the emulsifier/diesel fuel solution in an amount to obtain 10 volume percent water. The mixture was emulsified using a high-speed blender. The data demonstrates that when 2-EHN was added to the water-in-oil emulsion, CO and PM were reduced, the rate of increase of HC was reduced, and $NO_x$ was unaffected when compared to the water-in-oil emulsion alone.

TABLE 1

| | Hot Start Transient Emissions (g/hp-hr) | | | |
|---|---|---|---|---|
| Fuel | HC | CO | $NO_x$ | PM |
| DF (Phillips 2-D Diesel fuel) | 0.084 | 2.135 | 4.544 | 0.179 |
| DF + 0.85% Emulsifier + 10% Water | 0.185 | 1.469 | 4.166 | 0.098 |
| DF + 0.85% Emulsifier + 10% Water + 0.5% 2-EHN | 0.170 | 1.260 | 4.164 | 0.090 |
| DF + 0.85% Emulsifier + 10% Water + 2.0% 2-EHN | 0.157 | 1.096 | 4.173 | 0.088 |

What is claimed is:

1. A fuel composition which consits of (i) a water-in-oil emulsion comprising a major proportion of a hydrocarbonaceous middle distillate fuel and about 1 to about 40 volume percent water, (ii) a CO emission, and particulate matter emission reducing amount of at least one fuel-soluble organic nitrate ignition improver, and optionally containing (iii) at least one component selected from the group consisting of di-hydrocarbyl peroxides, surfactants, dispersants, organic peroxy esters, corrosion inhibitors, antioxidants, anti-rust agents, detergents, lubricity agents, demulsifiers, dyes, inert diluents, and a cyclopentadienyl manganese tricarbonyl compound.

2. A composition according to claim 1 wherein the organic nitrate ignition improver comprises a nitrate ester of a substituted or unsubstituted aliphatic or cycloaliphatic alcohol.

3. A composition according to claim 2 wherein the organic nitrate ignition improver consists essentially of a mixture of primary hexyl nitrates.

4. A composition according to claim 2 wherein the organic nitrate ignition improver consists essentially of a nitrate ester of at least one primary alkanol having 5 to 10 carbon atoms in the molecule.

5. A composition according to claim 3 wherein the organic nitrate is 2-ethylhexyl nitrate.

6. A composition according to claim 1 additionally comprising at least one cyclopentadienyl manganese tricarbonyl compound in an amount equivalent to up to 0.016 gram of manganese per liter of hydrocarbonaceous fuel.

7. A composition according to claim 6 wherein said at least one cyclopentadienyl manganese tricarbonyl compound is methylcyclopentadienyl manganese tricarbonyl.

8. A composition according to claim 1 additionally comprising (iii) at least one di-hydrocarbyl peroxide in an amount sufficient to improve the thermal stability of said water-in-oil emulsion fuel composition containing (ii) in the absence of (iii).

9. A composition according to claim 8 wherein the di-hydrocarbyl peroxide is di-tert-butyl peroxide.

10. A composition according to claim 9 wherein the organic nitrate ignition improver comprises a nitrate ester of at least one primary alkanol having 5 to 10 carbon atoms in the molecule.

11. A composition according to claim 10 wherein the organic nitrate ignition improver is 2-ethylhexyl nitrate.

12. A composition according to claim 7 wherein the organic nitrate ignition improver is 2-ethylhexyl nitrate.

13. In a combustion process wherein a middle distillate diesel fuel is subjected to combustion in the presence of air within a combustion chamber of a compression ignition diesel engine, a method of reducing the amount of emissions in the exhaust gases of the diesel engine which comprises supplying to and burning in said combustion chamber a water-in-oil emulsion fuel composition as defined in claim 1.

14. In a combustion process wherein a middle distillate diesel fuel is subjected to combustion in the presence of air within a combustion chamber of a compression ignition diesel engine, a method of reducing the amount of emissions in the exhaust gases of the diesel engine which comprises supplying to and burning in said combustion chamber a water-in-oil emulsion fuel composition as defined in claim 3.

15. In a combustion process wherein a middle distillate diesel fuel is subjected to combustion in the presence of air within a combustion chamber of a compression ignition diesel engine, a method of reducing the amount of emissions in the exhaust gases of the diesel engine which comprises supplying to and burning in said combustion chamber a water-in-oil emulsion fuel composition as defined in claim 4.

16. In a combustion process wherein a middle distillate diesel fuel is subjected to combustion in the presence of air within a combustion chamber of a compression ignition diesel engine, a method of reducing the amount of emissions in the exhaust gases of the diesel engine which comprises supplying to and burning in said combustion chamber a water-in-oil emulsion fuel composition as defined in claim 5.

17. The fuel composition of claim 1, wherein the amount of ignition improver reduces the amount of HC emissions relative to a composition which is the same as said fuel composition but for having an absence of the ignition improver.

18. The fuel composition of claim 1, consisting essentially of the distillate fuel, water and ignition improver and, optionally at least one member of the group consisting of a cyclopentadienyl manganese tricarbonyl compound and a di-hydrocarbyl peroxide.

19. The fuel composition of claim 1, comprising about 2 to about 20 weight percent water.

20. The fuel composition of claim 19, comprising about 2 to about 10 weight percent water.

* * * * *